US010806953B2

(12) United States Patent
Brose et al.

(10) Patent No.: US 10,806,953 B2
(45) Date of Patent: Oct. 20, 2020

(54) BREATHING APPARATUS

(71) Applicant: SATA GMBH & CO. KG, Kornwestheim (DE)

(72) Inventors: Jens Brose, Ottmarsheim (DE); Ralf Gehrung, Stuttgart (DE)

(73) Assignee: SATA GMBH & CO. KG, Kornwestheim (DE)

( * ) Notice: Subject to any disclaimer, the term of this patent is extended or adjusted under 35 U.S.C. 154(b) by 769 days.

(21) Appl. No.: 15/304,085

(22) PCT Filed: Apr. 9, 2015

(86) PCT No.: PCT/EP2015/000745
§ 371 (c)(1),
(2) Date: Oct. 14, 2016

(87) PCT Pub. No.: WO2015/158420
PCT Pub. Date: Oct. 22, 2015

(65) Prior Publication Data

US 2017/0028230 A1 Feb. 2, 2017

(30) Foreign Application Priority Data

Apr. 16, 2014 (DE) ..... 10 2014 005 544

(51) Int. Cl.
*A62B 23/02* (2006.01)
*A62B 18/00* (2006.01)
(Continued)

(52) U.S. Cl.
CPC ..... *A62B 23/02* (2013.01); *A62B 7/12* (2013.01); *A62B 9/006* (2013.01); *A62B 17/04* (2013.01);
(Continued)

(58) Field of Classification Search
CPC ..... A62B 23/02; A62B 7/12; A62B 9/006; A62B 17/04; A62B 18/003; A62B 7/10;
(Continued)

(56) References Cited

U.S. PATENT DOCUMENTS 2,894,508 A * 7/1959 Miles ..... A62B 18/003 128/206.17
3,565,068 A * 2/1971 Bickford ..... A62B 7/10 128/201.25
(Continued)

FOREIGN PATENT DOCUMENTS

CA 2147963 A1 10/1996
CN 101415467 A 4/2009
(Continued)

OTHER PUBLICATIONS

International Search Report dated Sep. 9, 2015 for International Application No. PCT/EP2015/000745, filed Apr. 9, 2015, 3 pages.
(Continued)

*Primary Examiner* — Timothy A Stanis
*Assistant Examiner* — Jonathan S Paciorek
(74) *Attorney, Agent, or Firm* — Paul D. Bianco; Gary S. Winer; Fleit Intellectual Property Law

(57) ABSTRACT

A portable breathing apparatus for protecting a user against contact with the contaminated surrounding atmosphere. The breathing apparatus can be supplied with fresh breathable air via an air tube connected to an air supply system having an overpressure. The breathable air flows out of a body which is connected to the air tube and has at least one defined outflow surface for the breathable air.

20 Claims, 7 Drawing Sheets

(51) Int. Cl.

| | |
|---|---|
| ***A62B 7/12*** | (2006.01) |
| ***A62B 9/00*** | (2006.01) |
| ***A62B 17/04*** | (2006.01) |
| ***A62B 19/00*** | (2006.01) |
| ***A62B 7/10*** | (2006.01) |

(52) U.S. Cl.
CPC ..... *A62B 18/003* (2013.01); *A62B 7/10* (2013.01); *A62B 19/00* (2013.01)

(58) Field of Classification Search
CPC . A62B 19/00; A61M 16/105; A61M 16/1055; A61M 16/1065; A61M 16/107; A61M 2205/75; A61M 2205/7509; A61M 2205/7518; A61M 2205/7527; A61M 2205/7536; A61M 2205/7545; A61M 2205/75454; A61M 2205/7563; A61M 2205/7572; A61M 2205/7581; A61M 2205/759
See application file for complete search history.

(56) References Cited

U.S. PATENT DOCUMENTS

| | | | | |
|---|---|---|---|---|
| 3,683,907 A | | 8/1972 | Cotabish | |
| 4,098,270 A | * | 7/1978 | Dolby | A62B 18/02 128/206.12 |
| 4,196,728 A | * | 4/1980 | Granite | A61M 16/1045 128/201.13 |
| 4,207,883 A | | 6/1980 | Shindler | |
| 4,850,346 A | * | 7/1989 | Michel | A62B 18/025 128/206.15 |
| 5,592,935 A | * | 1/1997 | Elstran | A62B 7/02 128/205.25 |
| 2004/0003810 A1 | * | 1/2004 | Templeton | A62B 17/04 128/201.22 |
| 2004/0112381 A1 | * | 6/2004 | Ujhazy | A61M 16/00 128/204.18 |
| 2004/0226558 A1 | | 11/2004 | Kausch | |
| 2007/0235031 A1 | | 10/2007 | Betz | |

FOREIGN PATENT DOCUMENTS

| | | |
|---|---|---|
| DE | 21 35 928 | 1/1972 |
| DE | 29 27 805 | 1/1980 |
| DE | 150148 A1 | 8/1981 |
| DE | 19615570 A1 | 10/1996 |
| DE | 19516485 A1 | 11/1996 |
| GB | 1511303 A | 5/1978 |
| GB | 2401553 A | 11/2004 |

OTHER PUBLICATIONS

Written Opinion dated Oct. 22, 2015 for International Application No. PCT/EP2015/000745, filed Apr. 9, 2015, 5 pages.
International Preliminary Examination Report dated Oct. 18, 2016 with English translation of Written Opinion for PCT/EP2015/000745, 6 pages.
Search report for German Utility Appl No. 20 2014 003 214.9 dated Apr. 2014.
English translation of search report for German Utility Appl No. 20 2014 003 214.9 dated Apr. 16, 2014. 5 pages.
Chinese Search Report dated Apr. 10, 2014 for Application No. 2018120601879980 with English translation.

* cited by examiner

BREATHING APPARATUS

FIELD OF THE INVENTION

The invention concerns a portable breathing apparatus for protection of the user from contact with contaminated surrounding atmosphere.

Breathable air in such breathing apparatuses, which are used, for example, during performance of painting work, is supplied via an air tube, generally a breathable air tube, to the interior of the breathing apparatus. The breathable air tube in the breathing apparatus known from DE 195 16 485 C2 has a number of slit-like openings in the noise-mouth area of the breathing apparatus, through which the breathable air can enter the interior of the breathing apparatus. In the embodiment example of this breathing apparatus, the breathable air tube is enclosed by a sleeve consisting of an elastic, rectangular foam block. The sleeve is ordinarily secured by a frame, which belongs to a so-called hood part of the breathing apparatus. Reliable supply of the user of the breathing apparatus with fresh air, in addition to reliable guiding of the breathable air tube, is thereby ensured.

However, in many cases, the breathable air supply is perceived as too loud, since the air under partial vacuum expands relatively quickly on emerging from the relatively narrow slit-like openings, which is connected with high noise development. Supply with more fresh air than is possible with slit-like opening is also sometimes desired.

SUMMARY OF THE INVENTION

A wearable breathing apparatus which provides an improved supply of fresh breathable air to the wearer of the breathing apparatus is disclosed.

Advantageous embodiments of the invention are also disclosed.

Emergence of breathable air in the claimed body serving as air outflow block, which has a defined outflow surface for breathable air, which extends at least roughly over the entire length of the body, can occur in concentrated fashion and over a large surface. The breathable air is neither compressed nor expanded in the transition from the tube to the body. Emergence of air in the breathing device is also thus quieter.

It is essential to the invention that the body can satisfy a filtration function for the breathable air. This can be achieved with particular advantage by choice of an appropriate material for the entire body and/or by means of an appropriate filler material for the body. "Filtration" in the present case then means that the breathable air should keep interfering molecules, like water droplets, oil droplets, dust particles, health-hazardous gases or vapor or the like, away from the user of the breathing apparatus. This can occur by using material that can bind the interfering molecules or particles by adsorption owing to its large surface and/or through the use of a material that can absorb the interfering molecules by absorption.

In a particularly advantageous embodiment the body consists of an air-permeable material at least in the area of the outflow surface, especially a sintered material. It is known for production of sintered elements that granulate can be melted together or bonded via a precisely defined and controlled sintering process so that a stable body is formed. A targeted effect on pore size can be exerted by choosing the granulate and process parameters. This is true for both plastic granulates and metal granulates, as well as ceramic granulates.

In another embodiment of the invention the body is additionally filled with a filter material. The filter material can preferably be an activated carbon usable in ordinary breathing apparatuses. Additional filtering and/or processing of the breathing air is thereby ensured.

It is particularly advantageous if a single, large, continuous air outflow surface is provided. However, it is also possible to divide such a surface by cross ribs or the like. In order to ensure that air emergence from the body is only possible on defined areas, it is air-impermeable on its other areas, especially coated by an air-impermeable insulation layer. In order to optimize air supply to the user or wearer of the breathing apparatus, it is proposed to additionally provide at least one air guide through which the air is guided, preferably fanned out on the way to the user.

BRIEF DESCRIPTION OF THE DRAWINGS

Embodiment examples of the invention are further explained subsequently with reference to the drawings.

In the drawings

DETAILED DESCRIPTION OF THE INVENTION

Figure 1:
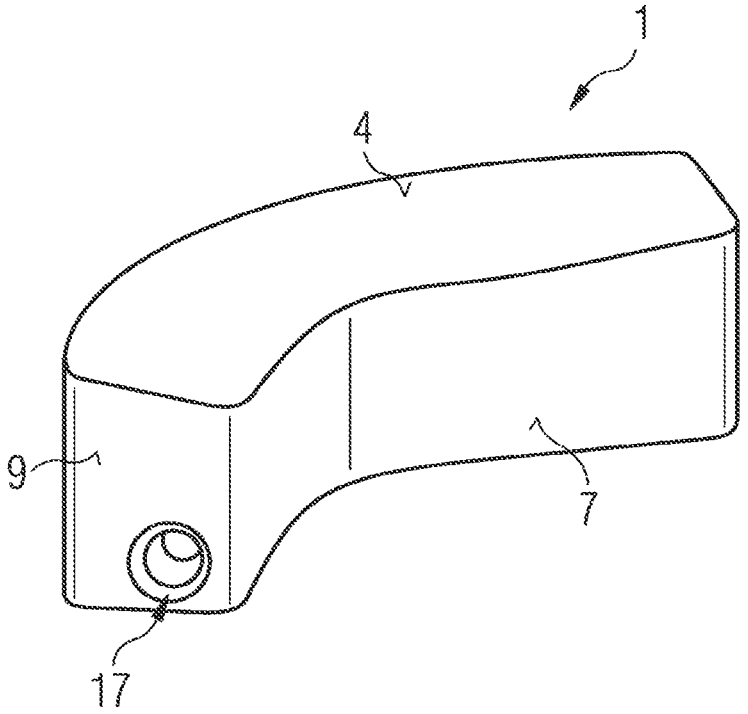
FIG. 1 shows an air outflow body according to the invention in a perspective view.

The body 1 depicted in FIGS. 1 to 7 and 12 is provided for use as an air outflow body in a breathing apparatus for protection of its user from contact with contaminated surrounding atmosphere. Breathable air can be fed to the breathing apparatus via an air hose 2, which in the present embodiment example is an ordinary breathable air tube 2 connected to an ordinary air supply system operated at an overpressure. Instead of the hose, any other body appropriate as air hose can, of course, be used, for example, a tube. The air outflow body 1 is expediently mounted in a frame 3 (see FIG. 12), which is a component of the breathing apparatus designed as a hood (not further shown).

Body 1 in the present embodiment example is designed essentially as a cuboid block and has an outflow surface 4 for fresh breathable air. The outflow surface 4 extends over the entire length of body 1.

A cuboid block shape is, of course, not essential; other shapes, like cylinders (straight or bent), cones or spheres are also possible.

The body 1 consists fully of an air-permeable, porous sintered material 100. The sintered material can keep molecules that interfere with the breathable air, like water droplets, oil droplets, dust particles or the like, away from the user of the breathing apparatus. The sintered material because of its large surface can bind the interfering molecules or particles by adsorption at the interface between the body and air. This sintered material, however, can also absorb the interfering molecules or particles by absorption. Plastic granulates, metal granulates and ceramic granulates are known that possess such filtration properties. The air outflow body consists of ceramic in the present example. It is known that excellent filtration performance with special chemical stability and high strength is ensured with ceramic filters.

Except on the outflow surface 4, it is thinly coated with an air-impermeable insulation layer not further shown or marked. The insulation layer can be a resin, a paint or a ceramic material. The material chosen for the insulation layer should have not have or develop any unpleasant odor or be hazardous to health. The same, of course, applies to the sintered material 100.

On the other hand, air impermeability on the corresponding surfaces could also be achieved by the fact that the sintered material is more strongly compacted here. It would likewise be possible to provide the body 1 with a separate sleeve or the like on the outflow surface 4.

Figure 8:
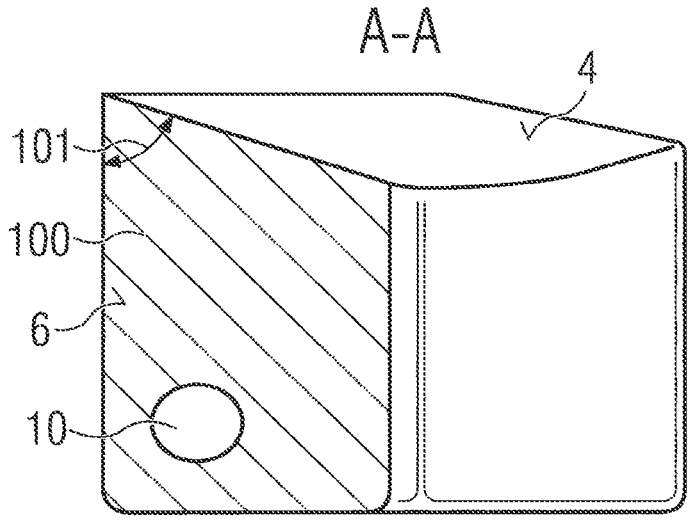
FIG. 8 shows a sectional view along line A-A of the same body in an enlarged scale.

The lower surface 5, the front surface 6, the back surface 7, the side surface 8 on the left and the side surface 9 on the right in the present embodiment example are coated with the insulation layer. The outflow surface 4 apparent on the top of the drawing in FIG. 8 runs at an angle 101 of about 50° to the front surface 6. The outflow surface 4 is therefore much larger than the other surfaces of body 1.

If desired, the outflow surface 4 can also be divided by preferably narrow cross ribs or the like.

Figure 2:
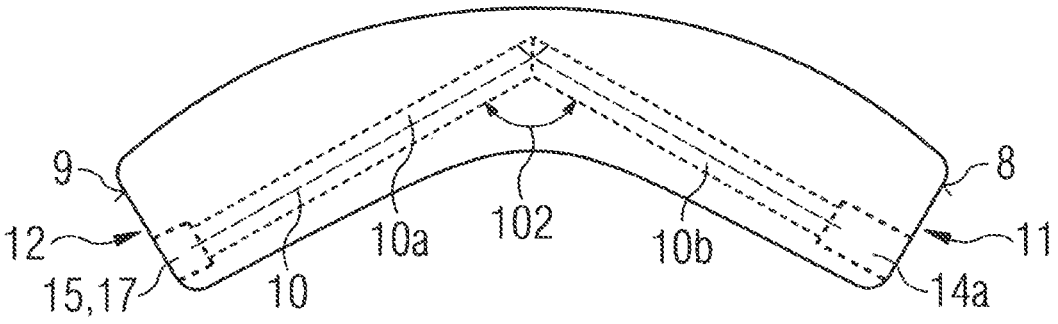
FIG. 2 shows the same body in a bottom view.
Figure 3:
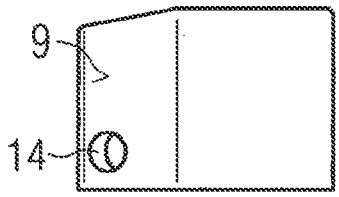
FIG. 3 shows the same body in a side view.
Figure 4:
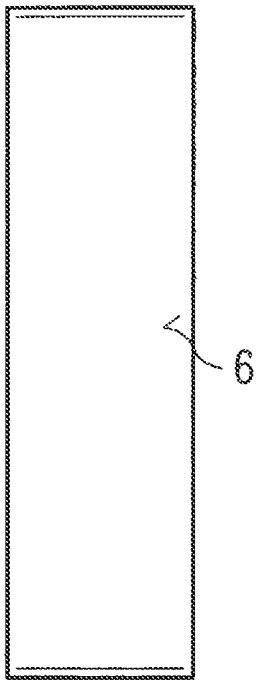
FIG. 4 shows the same body in a front view.
Figure 5:
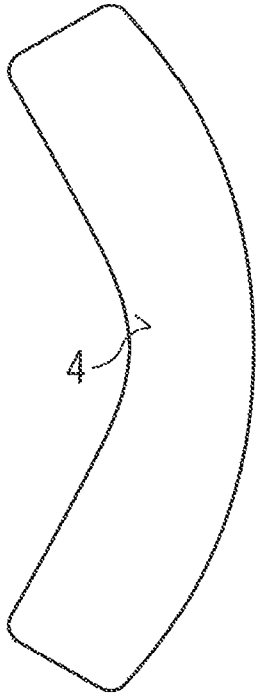
FIG. 5 shows the same body in a bottom view.
Figure 6:
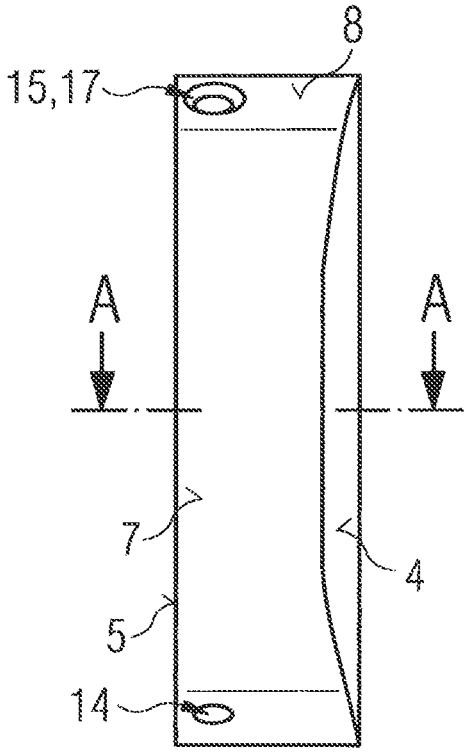
FIG. 6 shows the same body in a rear view.
Figure 7:
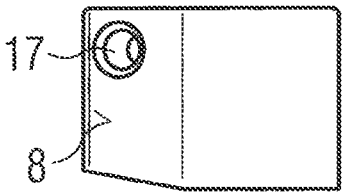
FIG. 7 shows the same body in a side view on the left.

As shown in FIG. 2, the body 1 is penetrated by an air channel 10, which extends from the first end 11 of body 1, which in the present embodiment example is formed from the left side of surface 8, to a second end 12, which lies opposite the first end 11 and in the present embodiment example is formed by the right side surface 9.

As shown in particular by FIG. 1, the air channel 10 is arranged close to the lower surface 5 of the air outflow body 1. The air is therefore guided over a great height through a large mass of porous sintered material 100, for which reason an excellent filter effect is achieved with only limited outflow noise development.

Figure 12:
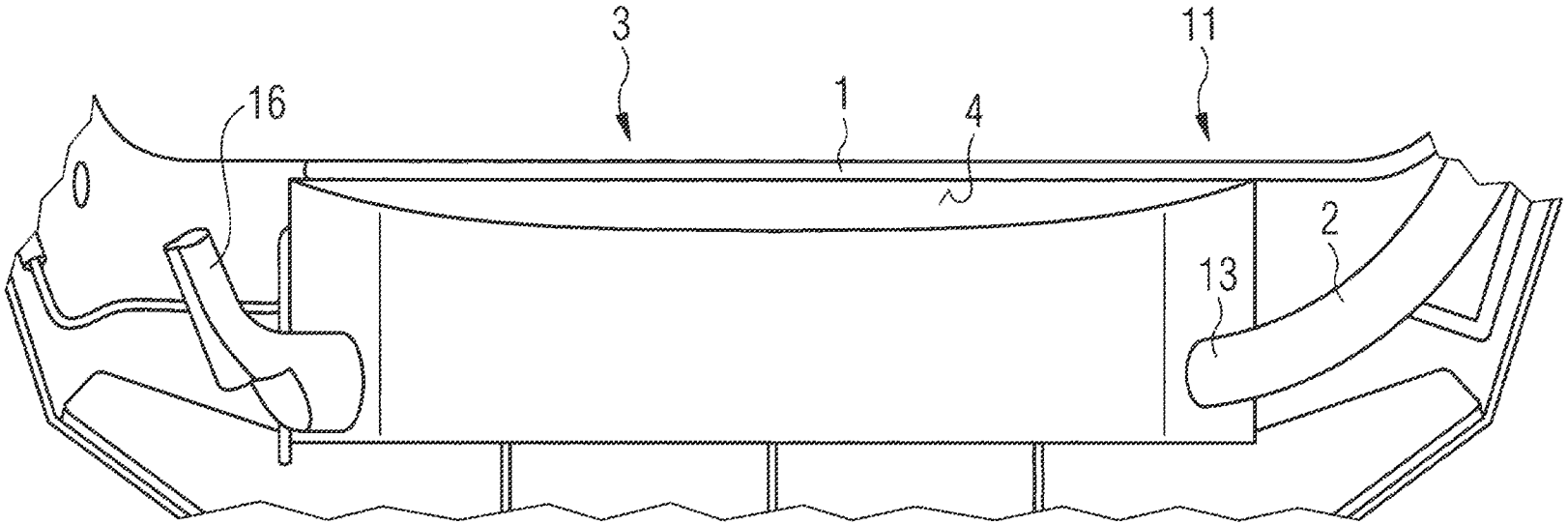
FIG. 12 shows a body according to the invention in an appropriate mount.

The dimensional ratios in the present example are such that the distance between the lower surface 5 and the outflow surface 4 is roughly four times as large as the diameter of the air channel 10, which here is an ordinary breathable air tube about 1 cm in diameter. The air channel 10 is again provided roughly a diameter size above the lower surface 5 of the air outflow body 1. The entire outflow block 1 is about four times as long as wide; its height corresponds to about 120% of its width. However, other dimensions can also be chosen; it is essential that the air channel 10 be provided as far away as possible from the outflow surface 4. A greater distance has both a positive effect on filter action as well as reduction of noise development. If the distance is too small, noise development can be perceived by some persons as undesirably high. The breathable air tube 2, especially as FIG. 12 shows, is connected with one free end 13 to first end 14 of air channel 10. This end 14 of air channel 10 is equipped with a mount 14*a* for the breathable air tube 2, which is designed to fit the breathable air tube 2. On the other hand, a different embodiment can be equipped with a tube clamp or the like. It is essential that a pressure-tight tube connection be ensured.

As previously mentioned, instead of a breathable air tube, any other body appropriate as air hose can, of course, be used, for example, a tube.

The other second end 15 of air channel 10 is equipped or can be equipped with an alarm device which warns of unduly low volumetric flow. The alarm device is designed here as a warning whistle 16. The air channel 10 in the present example is widened in the area of its second end 15 so that a matching mount 17 for the warning whistle 16 is provided. If a different alarm device or even no alarm device is to be used, the mount 17 can, of course, be designed differently or left out. An alarm device could also be provided at another location, for example, on or in the breathable air tube 2.

The mounts 14, 17 can be widened conically in order to permit easier introduction of the breathable air tube (see, for example, FIG. 1).

As previously mentioned, the air outflow body 1 consists fully of an air-permeable, porous sintered material 100. The air channel 10 is formed from the die in a single piece with the block-like air outflow body 1; i.e., by leaving the air channel open in the sintered mass. On the other hand, it could also be drilled into the air outflow body 1 or introduced to the material in some other way. However, this is not always easy to produce. The best suited manufacturing method depends upon the type of starting material, which need not necessarily be a sintered material, and upon the individually desired configuration of the air outflow body 1.

To summarize, the outflow of breathable air from body 1 can occur over a large area and in concentrated fashion because of the outflow surface 4 just described. The breathable air is neither compressed nor expanded on transitioning from tube 2 into the air outflow body 1. The outflow of air also thus has a quieter effect in the breathing apparatus.

Since the outside contours of body 1 in the present embodiment example are adapted to the inside contours of frame 3 (see FIG. 12) and, as a result, body 1 is bent in a top view roughly into a C-shape, the air channel 10 has two connected sections 10*a* and 10*b* which run toward each other at an angle 102 of about 120°.

It is, of course, also possible to configure air channel 10 in a single piece and in a shape bent according to body 1. It is essential that the air channel 10 can supply the outflow surface 4 with fresh breathable air with a high efficiency.

The frame 3, as required, can be provided with perforations on a holding surface for the air outflow block 1.

The frame 3 can have cross ribs or the like for fixation of the breathable air tube 2. If the breathable air tube 2 is guided loosely, problem-free passage of the tube in the hood part is possible if the visor is tilted up and down. When tilted up, the tube is pushed out slightly from the inlet opening on the rear end of the hood and, when the visor is tilted down, it is pushed farther into the inlet opening.

The air outflow body 1 during use of the breathing apparatus preferably extends beneath the nose-mouth area of the user of the breathing apparatus. Particularly reliable supply of the wearer of the breathing hood with fresh unloaded breathable air is ensured with such a device.

If required or desired, at least one additional outflow surface 4 can be provided on body 1. For example, the surface 7, which runs parallel to the face of the user of the breathing apparatus during use of the breathing apparatus, could also be entirely or partially configured as outflow surface 4.

However, the body could also be provided in the lateral or in the upper face area of the wearer of the breathing apparatus.

Figure 9:
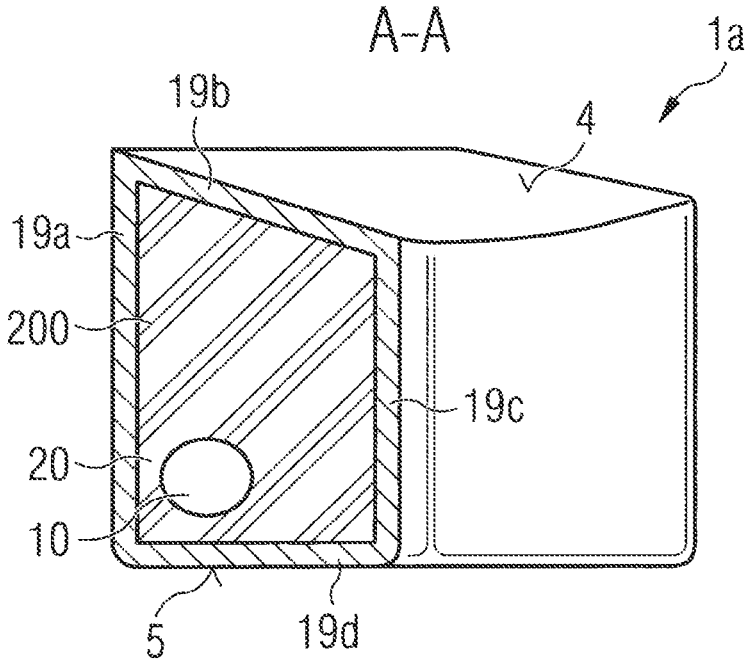
FIG. 9 shows a sectional view along line A-A of a similar second body according to the invention in an enlarged scale.

In the variant according to FIG. 9, the air outflow body 1*a* is configured the same in outline as the previously depicted body 1. The same details are provided with the same reference numbers. In contrast to the body 1 consisting of solid material, the air outflow body 1*a* is configured as a hollow block. It has relatively thin walls 19*a-e* made of air-permeable porous sintered material 100. These walls 19*a-e* enclose a large cavity 20.

The cavity 20 in the present example is filled with an activated carbon 200 common in breathing apparatuses as additional filter material. Thus, particularly good filtering of the usable air is ensured. The additional filter material, which, of course, need not necessarily be activated carbon, can preferably be sintered-in.

The air channel 10 not further shown in this embodiment example then runs through the activated carbon.

Figure 10:
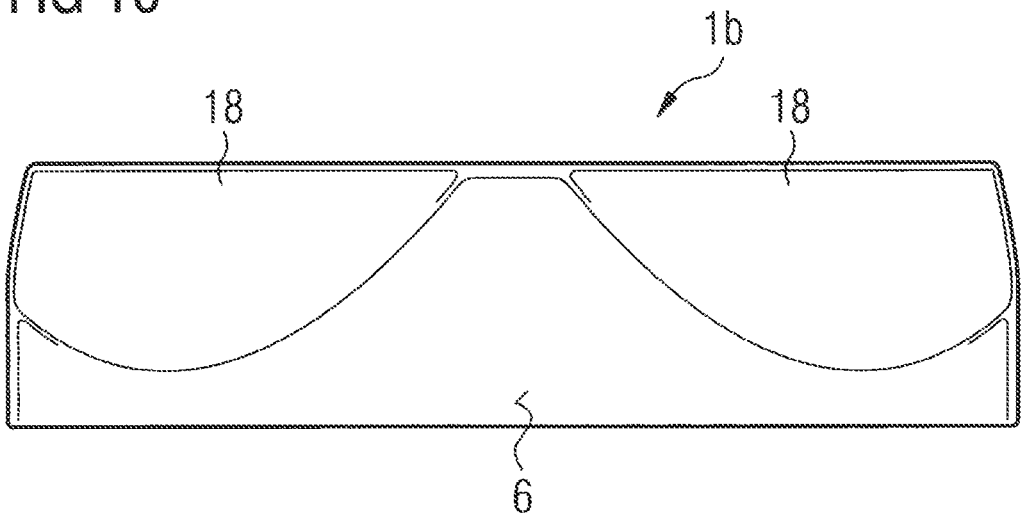
FIGS. 10 and 11 show a third variant of the body according to the invention in a front view and in a side view; the latter in an enlarged scale.
Figure 11:
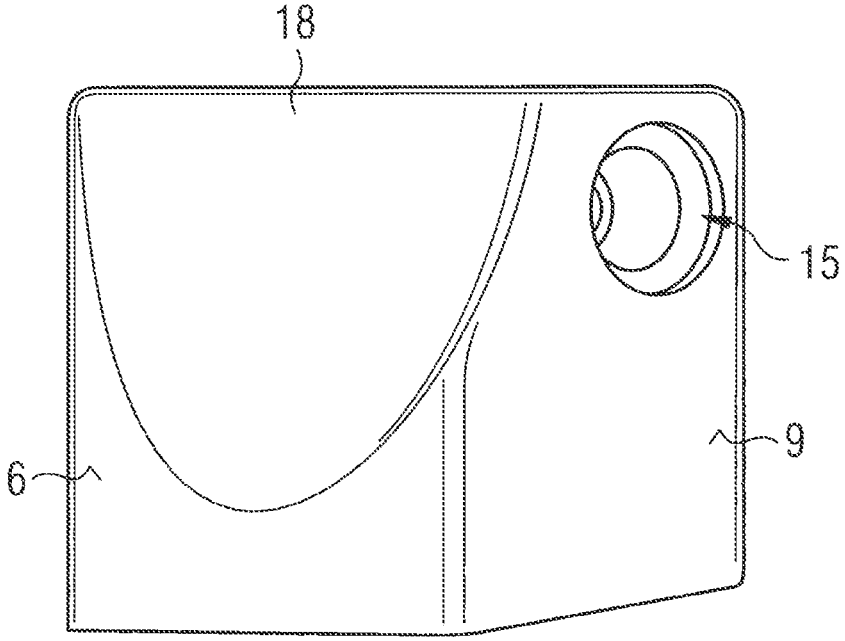

In order to reduce the weight of the air outflow block 1, in the variants depicted in FIGS. 10 and 11—the same details are provided with the same reference numbers as in the variants according to FIGS. 1 to 8—material in the area of the front surface 6 can be removed or left out. Two roughly dome-like hollows 18 are situated to the left and right of the center of front surface 6. The hollows 18 extend from the side surfaces 8 and 9 of the air outflow block 1 roughly over three-fourths of its length and height and over about 10 to 15% of its width. Other structural embodiments of one or more material recesses are, of course, possible, depending on the individually desired appearance and individual requirements.

Figure 13:
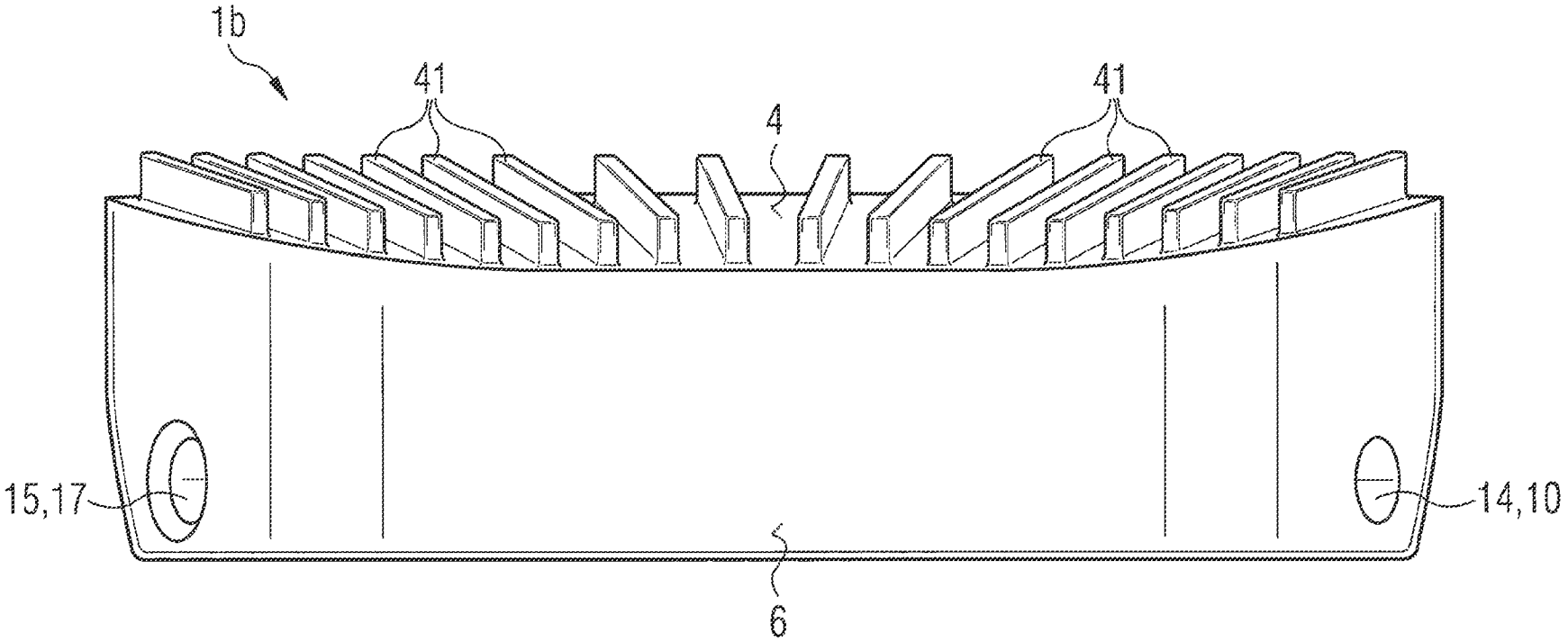
FIGS. 13 and 14 show a fourth and fifth variant of a body according to the invention in a perspective view.
Figure 14:
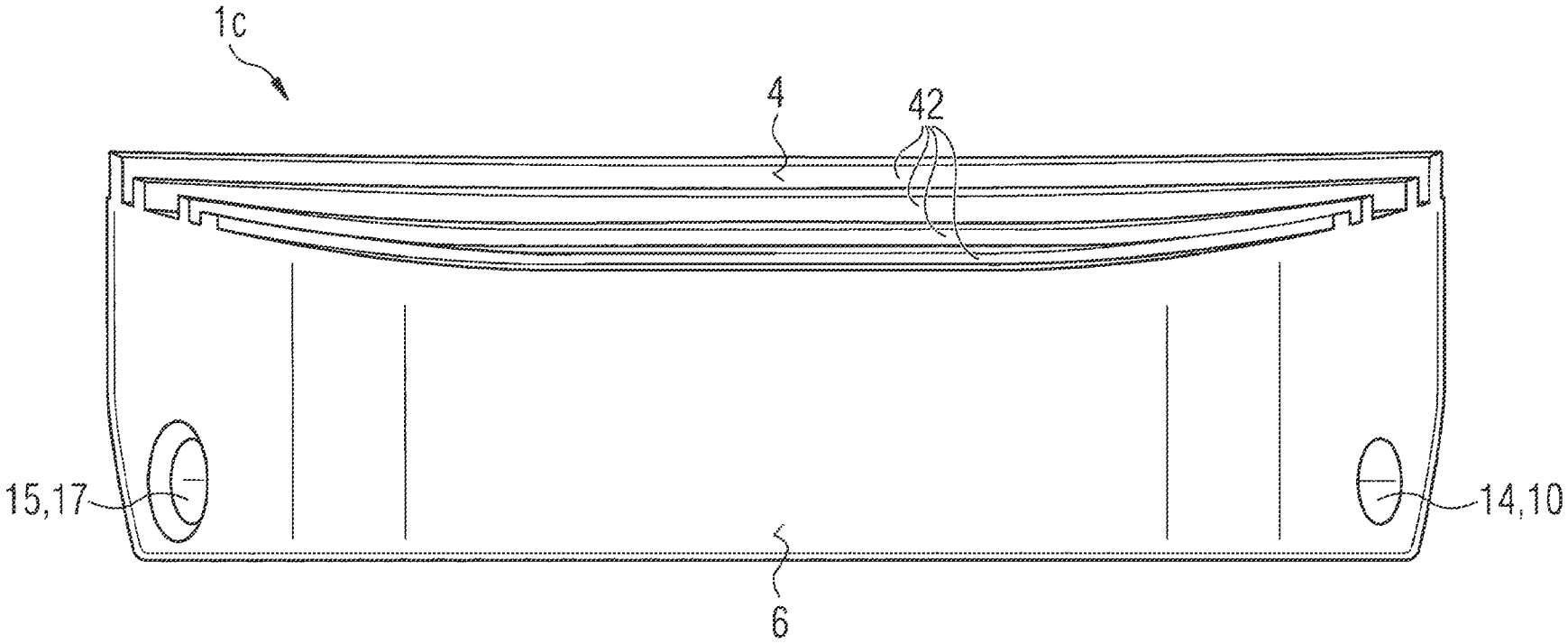

In the two additional variants according to FIGS. 13 and 14 (the same details are provided with the same reference numbers as in the variants according to FIGS. 10 and 11) several air guides 41 and 42 are provided on the body 1*c* and 1*d* in the area of outflow surface 4 for the breathable air that flows out from the outflow surface 4.

In the variant according to FIG. 13 a number of air guides 41 extend roughly across body 1*c*. The air guides 41 in the present embodiment example are designed to be rectangular or cuboidal in cross section. They extend at the same distances from each other over about 10 to 20% of the height of body 1*c* at an angle of about 90° to outflow surface 4.

The variant show in FIG. 14 also has a number of air guides 42, which, however, extend in the longitudinal area along body 1*d*. They are rectangular in cross section and extend over about 10 to 15% of the height of body 1*d*. In the present embodiment example, two air guides 42 are provided in pairs close to the outer longitudinal edges of outflow surface 4.

For the variants according to FIGS. 13 to 14, air supplied to the user or wearer of the breathing apparatus is fanned out by the air guides 41, 42. The partial air streams produced this way are perceived by the user as milder.

The air guides 41, 42 need not necessarily be cuboid with sharp edges. They can also be shaped shovel-like, blade-like or in any other conceivable configuration. They also need not be equally large. They can also be more or less thick. They can be configured flat or not flat. They also need not be arranged uniformly and at an angle of 90°. It is essential that they can divide up the air stream without problem.

In many cases, however, it could be desirable to channel the air stream further with the air guides. In this case, application of such air guides only along one or more outside lines of the outflow surface would be recommended. Other arrangements are easily conceivable according to individual requirements.

The air guides 41, 42 in the present embodiment examples are molded or sintered in a single piece on the body 1*c* and 1*d*. Particularly simple manufacture is thereby ensured. The application of separately produced air guides by gluing, sealing, attachment or in some other way, however, is also possible.

In another embodiment of the invention, each of the air outflow bodies according to the invention could also be used in combination with a previously used slit breathable air tube. The breathable air tube could then penetrate the previously described or a similar air channel. The breathable air could then penetrate the sintered material or the like after passing through the slit and then emerge from the defined air outflow surface. The air outflow body need not necessarily be configured in a single piece, as in the previously described embodiment examples. Two or multipart shapes with or without a cover are also possible. The bodies according to the invention could also advantageously be used in gas processing or gas purification devices other than in a breathing apparatus. It is essential that it have at least one defined outflow surface.

The invention claimed is:

1. A portable breathing apparatus for protection of a user from contact with contaminated surrounding air, in which fresh breathable air can be supplied to the breathing apparatus via an air supply tube connected to an air supply system having an overpressure, the apparatus comprising:

a body:

(a) formed of a fixed interior block of air permeable filtering material, (b) having an air channel extending within the interior block along a longitudinal length of the body and including a first opening which is connectable to the air supply tube for the communication of breathable air from the air supply tube, enabling the passage of breathable air from the air supply tube along an internal length of the body and into the interior block; and (c) having an air impermeable layer coating extending over the interior block except for at least one defined outflow surface portion through which the breathable air that has been filtered by the interior block can be released from the interior block;

whereby breathable air is releasable from the outflow surface portion for inhalation by the user.

2. The apparatus of claim 1, wherein the air-permeable material is a sintered material.

3. The apparatus of claim 1, wherein a cavity is formed in the interior block that can the filled with a filter material.

4. The apparatus of claim 3, wherein the filter material is activated carbon.

5. The apparatus of claim 1, wherein the body forms at least one air guide including raised surfaces in an area of the outflow surface portion.

6. The apparatus of claim 1, wherein the air channel runs next to a surface of the body which lies removed from the outflow surface portion of the body.

7. The apparatus of claim 1, further including a tube portion at least one of connected to and connectable to the air supply channel to communicate air, the tube portion at least one of positioned and positionable within the air channel, the tube portion including at least one opening extending along the air channel when the tube portion is positioned within the air channel, enabling the passage of air from the tube portion to the interior block.

8. The apparatus of claim 1, further including a hood having a visor, the hood covering at least one of a nose and a mouth of a user of the device when the device is worn by a user, the outflow surface portion on the body surface in air flow communication with an interior of the hood.

9. The apparatus of claim 1, the body forming two side portions disposed at an angle relative to each other, the body thereby forming a shape corresponding to a face, the body thereby proximate the nose and mouth of a user to not contact the nose or mouth of the user.

10. The apparatus of claim 1, wherein the only the outflow surface portion is not covered by the coating.

11. The apparatus of claim 1, wherein the body has a length that is four times longer than a width of the body.

12. The apparatus of claim 1, the outflow surface positioned at an upper side of the body, the air channel positioned within the body proximate a lower side of the body opposite to the upper side, whereby filtering by the interior block takes place between the air channel and the outflow surface.

13. The apparatus of claim 1, further including an alarm operative to signal a warning when air pressure within the body is below a predetermined level.

14. The apparatus of claim 1, the air channel extending through two opposite sides of the body, forming the first opening at a first of the two opposite sides, and forming a second opening at a second of the two opposite sides.

15. The apparatus of claim 14, wherein a low pressure alarm is connected to the second opening.

16. The apparatus of claim 1, wherein the air supply tube is inserted into the air channel.

17. The apparatus of claim 1, wherein the interior block is a mass of porous sintered material formed from granulates selected from plastic, metal, and ceramic.

18. The apparatus of claim 1, the apparatus mounted within a hood having a visor.

19. A portable breathing apparatus for protection of a user from contact with contaminated surrounding air, in which fresh breathable air can be supplied to the breathing apparatus via an air supply tube connected to an air supply system having an overpressure, the breathing apparatus mountable within a hood which covers at least one of the mouth and nose, the apparatus comprising:

a body:

(a) formed from an interior block of sintered porous air permeable filtering material;

(b) having an air channel extending within the body along a longitudinal length of the body and including a first opening which is connectable to the air supply tube for the communication of breathable air from the air supply tube, enabling the passage of breathable air from the air supply tube along an internal length of the air channel and into the interior block; and (c) having an air impermeable layer coating extending over the interior block except for at least one defined outflow surface portion through which the breathable air that has been filtered by the interior block can be released from the interior block that is in air communication with an interior defined by the hood;

whereby breathable air is releasable from the outflow surface portion for inhalation by the user when the user is enclosed by the hood.

20. The apparatus of claim 19, wherein the interior block is a mass of porous sintered material formed from compacted granulates selected from plastic, metal, and ceramic.

* * * * *